US010883316B2

(12) United States Patent
Samuel et al.

(10) Patent No.: US 10,883,316 B2
(45) Date of Patent: Jan. 5, 2021

(54) ROTARY STEERABLE REAMER LOCK AND METHODS OF USE

(71) Applicant: Halliburton Energy Services, Inc., Houston, TX (US)

(72) Inventors: Geoffrey Andrew Samuel, Edmonton (CA); Alben D'Silva, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 162 days.

(21) Appl. No.: 16/097,695

(22) PCT Filed: Jun. 6, 2016

(86) PCT No.: PCT/US2016/036018
§ 371 (c)(1),
(2) Date: Oct. 30, 2018

(87) PCT Pub. No.: WO2017/213620
PCT Pub. Date: Dec. 14, 2017

(65) Prior Publication Data

US 2019/0153785 A1 May 23, 2019

(51) Int. Cl.
*E21B 7/28* (2006.01)
*E21B 10/26* (2006.01)
(Continued)

(52) U.S. Cl.
CPC ..... *E21B 10/322* (2013.01); *E21B 7/04* (2013.01); *E21B 7/28* (2013.01); *E21B 10/26* (2013.01);
(Continued)

(58) Field of Classification Search
CPC ..... E21B 7/06; E21B 7/062; E21B 10/26–345
See application file for complete search history.

(56) References Cited

U.S. PATENT DOCUMENTS 5,472,057 A 12/1995 Winfree
7,234,544 B2 6/2007 Kent
(Continued)

FOREIGN PATENT DOCUMENTS

WO 2016/043709 A1 3/2016

OTHER PUBLICATIONS

International Search Report and Written Opinion issued in related PCT Application No. PCT/US2016/036018 dated Jan. 18, 2017, 16 pages.

*Primary Examiner* — Robert E Fuller
*Assistant Examiner* — Lamia Quaim
(74) *Attorney, Agent, or Firm* — Benjamin Ford; Baker Botts L.L.P.

(57) ABSTRACT

In some aspects, the present disclosure includes systems and methods for rotatably coupling a bottom-hole assembly to a drilling shaft for use in subterranean drilling operations. In one embodiment, the methods of the present disclosure are suitable for underreaming a portion of a wellbore. The methods may comprise rotating a drilling shaft coupled to a drill bit about its axis to form a wellbore; engaging a first locking mechanism rotatably coupled to the drilling shaft with a second locking mechanism coupled to a housing to rotatably couple the drilling shaft and the housing; expanding an expandable reamer attached to the housing; and rotating the housing to widen at least a portion of the wellbore uphole from the drill bit. The bottom-hole may comprise one or more actuators that are selectively operable to engage the first and second locking mechanisms and expand the expandable reamer.

17 Claims, 7 Drawing Sheets

(51) Int. Cl.

| | |
|---|---|
| ***E21B 10/32*** | (2006.01) |
| ***E21B 7/04*** | (2006.01) |
| *E21B 10/30* | (2006.01) |
| *E21B 31/00* | (2006.01) |

(52) U.S. Cl.
CPC ..... *E21B 10/265* (2020.05); *E21B 10/30* (2013.01); *E21B 31/00* (2013.01)

(56) References Cited

U.S. PATENT DOCUMENTS

| | | | | |
|---|---|---|---|---|
| 8,789,579 | B2 | 7/2014 | Ollerenshaw et al. | |
| 8,936,110 | B2 | 1/2015 | Adam | |
| 9,068,407 | B2 | 6/2015 | Radford et al. | |
| 2004/0231893 | A1* | 11/2004 | Kent | E21B 7/067 175/74 |
| 2005/0284663 | A1* | 12/2005 | Hall | E21B 47/13 175/48 |
| 2010/0288557 | A1 | 11/2010 | Radford | |
| 2011/0284233 | A1* | 11/2011 | Wu | E21B 34/06 166/321 |
| 2014/0284110 | A1* | 9/2014 | Savage | E21B 7/062 175/61 |

* cited by examiner

ROTARY STEERABLE REAMER LOCK AND METHODS OF USE

CROSS-REFERENCE TO RELATED APPLICATION

The present application is a U.S. National Stage Application of International Application No. PCT/US2016/036018 filed Jun. 6, 2016, which is incorporated herein by reference in its entirety for all purposes.

TECHNICAL FIELD

The present disclosure relates generally to subterranean drilling operations, and more particularly, to rotary steerable drilling tools for use with a drilling shaft in subterranean drilling operations.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

Many subterranean operations require drilling boreholes with vertically deviated and horizontal geometries. A technique for drilling horizontal, vertically deviated, and other complex boreholes is directional drilling. Directional drilling involves controlling, with an ability to vary, the direction of the wellbore as it is being drilled. Oftentimes the goal of directional drilling is to reach a position within a target subterranean destination or formation with the drilling shaft. For instance, the drilling direction may be controlled to direct the wellbore towards a desired target destination, to control the wellbore horizontally to maintain it within a desired payzone, or to correct for unwanted or undesired deviations from a desired or predetermined path.

Various options are available for providing steering capabilities to a drilling tool for controlling and varying the direction of the wellbore. For example, directional drilling may be accomplished with a "rotary steerable" drilling system wherein the entire drilling shaft is rotated from the surface, which in turn rotates the drill bit, connected to the end of the drilling shaft. In a rotary steerable drilling system, the drilling shaft may be rotated while the drilling tool is being steered either by being pointed ("point-the-bit") or pushed ("push-the-bit") in a desired direction (directly or indirectly) by a steering device.

Some rotary steerable drilling systems may contain a reference housing. The reference housing may generally be used to assist in guiding the drill bit in the desired drilling direction. In the case of "point-the-bit" systems, the reference housing may be disconnected from the drilling shaft in the torsional direction to allow the drilling shaft to rotate freely within the housing. The drilling shaft may be flexed within the reference housing to point the drill bit in a different direction than the reference housing, thereby allowing for directional drilling.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
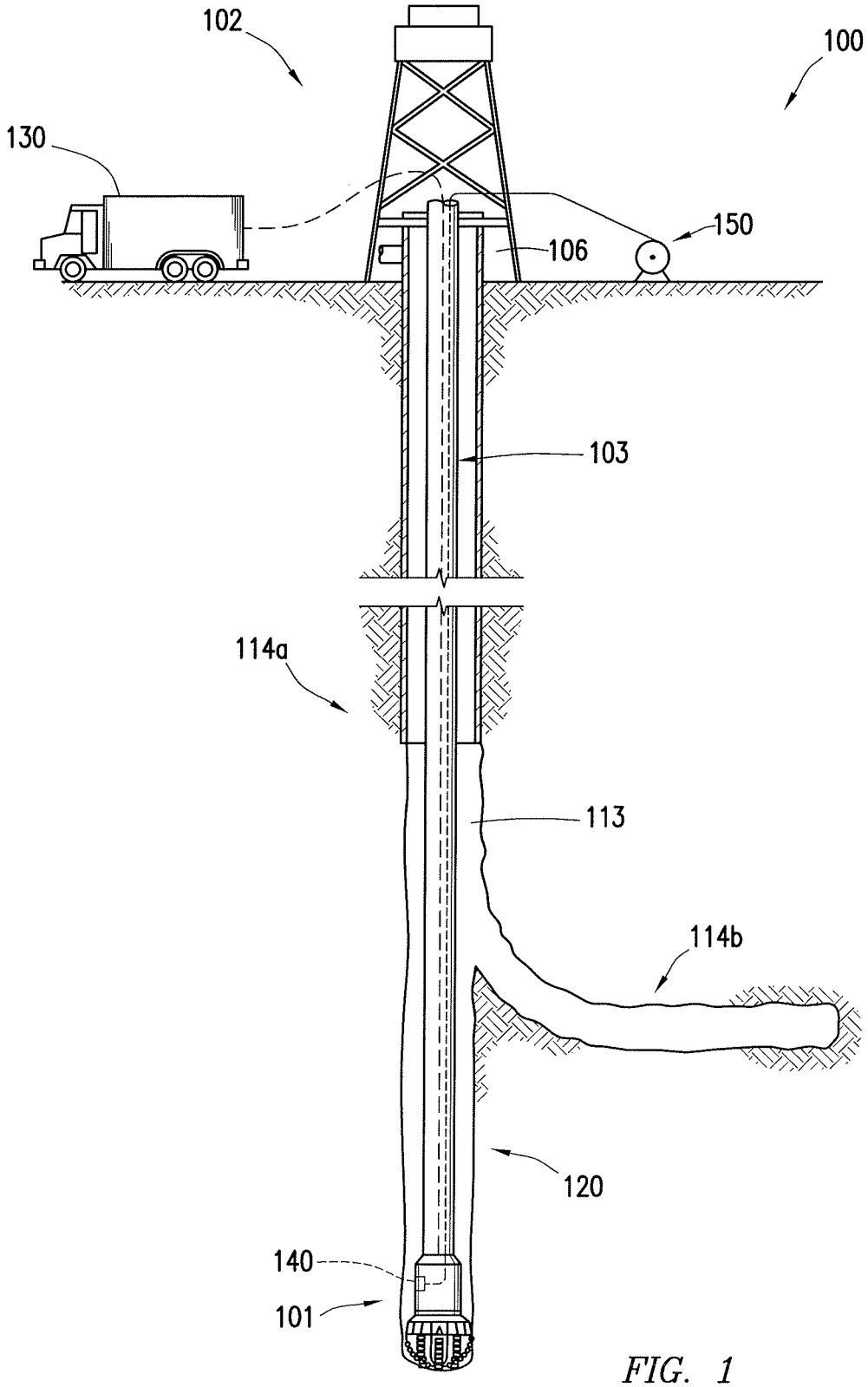
FIG. 1 is an elevation view of a directional drilling system in accordance with certain embodiments of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

The present disclosure relates generally to subterranean drilling operations, and more particularly, to rotary steerable drilling tools for use with a drilling shaft in subterranean drilling operations. A rotary steerable drilling system may be used with directional drilling systems for steering a drill bit to drill a non-vertical wellbore. These rotary steerable drilling systems generally fall into two classifications. In a "point-the-bit" system, the driveshaft connected to the drill bit is flexed to direct the drill bit in a desired direction. In a "push-the-bit" system, a force is asserted against the borehole to deflect the driveshaft and direct the drill bit in a desired direction.

A "point-the-bit" rotary steerable drilling system may comprise a reference housing surrounding the drilling shaft. The housing may be used to locate the tool within the wellbore. The location of the central axis of the drilling shaft may be altered within the housing to point the drill bit in the desired direction. This may cause the drill bit to drill in a direction different from the longitudinal direction of the housing, thereby directionally drilling. The reference housing may be disconnected from the shaft in the torsional direction to allow the drilling shaft to rotate freely within the housing. However, this eliminates the ability to transmit drive torque from the drilling shaft to the housing.

Because the housing is not rotating with the drilling shaft, there is a potential for the housing to become stuck in the wellbore. The housing can become stuck in numerous ways, but two common causes are formation caving and the housing becoming "kinked" or trapped in the bend of a wellbore during directional drilling. In order to free the housing, it is desirable to create a bottom-hole assembly ("BHA") for use with a rotary steerable drilling system that is capable of transmitting drive torque from the drilling shaft to the housing. To prevent the housing from getting stuck in the first place, or to further assist in freeing it once it has gotten stuck, it is also often desirable to strategically enlarge the portion of the wellbore uphole from the drill bit where the BHA is located.

As discussed in greater depth below, a BHA that comprises a reference housing capable of selectively engaging with the drilling shaft. When disengaged, the drilling shaft may rotate independently of the reference housing. Once engaged, the housing and the drilling shaft are rotatably coupled such that the housing rotates with the drilling shaft and the drilling shaft transmits drive torque to the housing. The BHA may comprise an expandable reamer. In an inactive and unengaged position, the reamer blades may be in a radially-retracted position where the cutting surfaces of the reamer blades do not contact the wellbore. In an active and engaged position, the reamer blades may be in the extended position that allows the cutting surfaces of the reamer blades to contact a portion of the wellbore, thereby enlarging the portion of the wellbore. The expandable reamer of the present disclosure is well suited for traditional underreaming operations where it is desirable to create an enlarged wellbore. The expandable nature of the disclosed reamer allows for flexible underreaming without requiring multiple trips down the wellbore.

As would be appreciated by one of ordinary skill in the art, having the benefit of the present disclosure, a BHA in accordance with the present disclosure may comprise an actuator for engaging the BHA to rotatably couple the housing to the drilling shaft. In response to a determination that the housing has become stuck in the wellbore, the actuator may be selectively operated to rotatably couple the housing to the drilling shaft. The torque transferred to the housing from the drilling shaft may be sufficient to free the housing. In certain conditions where additional freeing is required, a second actuator may be used to expand the expandable reamer blades to widen the portion of the wellbore surrounding the housing. Alternatively, both features may be engaged using a single actuator.

The present disclosure may be understood with reference to FIGS. 1 through 6, where like numbers are used to indicate like and corresponding parts. FIG. 1 is an elevation view of a drilling system. Drilling system 100 may include a well surface or well site 106. Various types of drilling equipment such as a rotary table, drilling fluid pumps and drilling fluid tanks (not expressly shown) may be located at well surface or well site 106. For example, well site 106 may include drilling rig 102 that may have various characteristics and features associated with a land drilling rig. However, downhole drilling tools incorporating teachings of the present disclosure may be satisfactorily used with drilling equipment located on offshore platforms, drill ships, semi-submersibles, and/or drilling barges (not expressly shown).

Drilling system 100 may include drilling shaft 103 coupled to drill bit 101 that is rotated about its axis to form a wide variety of wellbores or bore holes such as generally vertical wellbore 114*a* or generally horizontal wellbore 114*b* or any combination thereof. Various directional drilling techniques and associated components of BHA 120 of drilling shaft 103 may be used to form horizontal wellbore 114*b*. For example, lateral forces may be applied to BHA 120 proximate kickoff location 113 to form generally horizontal wellbore 114*b* extending from generally vertical wellbore 114*a*. The term directional drilling may be used to describe drilling a wellbore or portions of a wellbore that extend at a desired angle or angles relative to vertical. Such angles may be greater than normal variations associated with vertical wellbores. Directional drilling may include horizontal drilling.

Drilling system 100 may comprise a control station 130 for controlling BHA 120. Control station 130 may be communicatively coupled to BHA 120. Control station 130 may be permanently installed at the well site. Alternatively, control station 130 may be mounted to a mobile trailer for easy transport to and from the well site. Control station 130 may be used to control at least the direction, speed, and angle of drilling. Control station 130 may be used to actuate or activate one or more features of BHA 120. Control station 130 may receive data from one or more downhole sensors 140. The data received from the one or more downhole sensors 140 may be used to make decisions on whether or not to actuate or activate one or more features of BHA 120. These decisions may be made manually by an operator or automatically by a computer control system such as a DCS, PLC, or similar control system. Drilling system 100 may further comprise a hydraulic pump 150 fluidically coupled to one or more actuators of BHA 120. Hydraulic pump 150 may be located at a surface location. Alternatively, hydraulic pump 150 may be a mud pump located at a downhole location.

Figure 2:
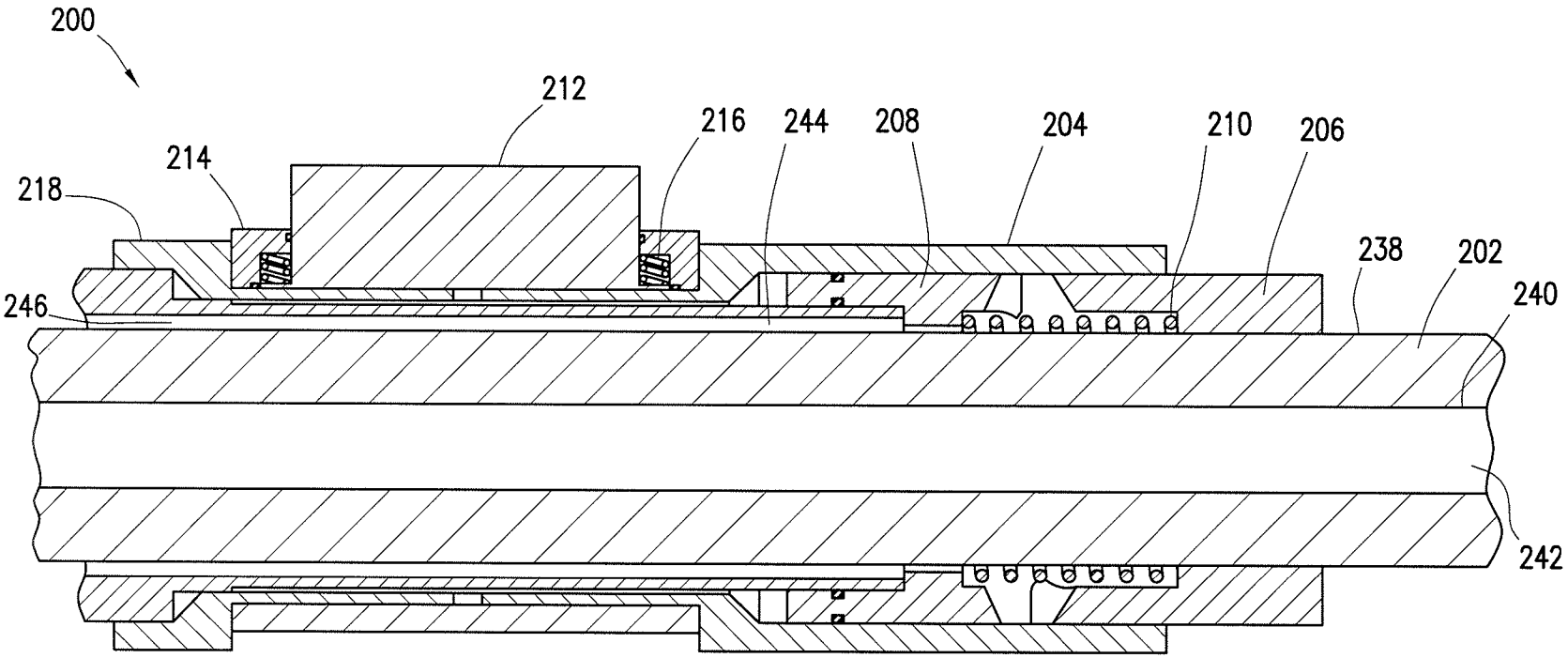
FIG. 2 is a cross-sectional view of an embodiment a bottom-hole shown in an inactive and unengaged position in accordance with certain embodiments of the present disclosure.

FIG. 2 is a cross sectional view of a BHA 200 shown in an inactive and unengaged position in accordance with the present disclosure. A generally cylindrical drilling shaft 202 may comprise any suitable metal or other material formed to have an outer circumference 238 and an inner circumference 240 defining a drillstring annulus 242. Drilling shaft 202 is positioned within generally tubular housing 204. Housing 204 may comprise a plurality of tools or sensors for use in the wellbore. An inner circumference 244 of housing 204 is sufficiently large to create a small spacing annulus 246 between the inner circumference 244 of housing 204 and the outer circumference 240 of drilling shaft 202. Spacing annulus 246 may allow the independent rotational movement of drilling shaft 202 and housing 204, when BHA 200 is in an inactive and unengaged position. A first locking mechanism 206 is rotatably coupled to drilling shaft 202. A second locking mechanism 208 is rotatably coupled to housing 204. Second locking mechanism 208 is positioned along the outer circumference 238 of drilling shaft 202 and may be capable of moving along the longitudinal axis of drilling shaft 202. Exemplary locking mechanisms include locking collars, friction pads, and similar devices. A first biasing element 210 is positioned between the first locking mechanism 206 and the second locking mechanism 207 and exerts a force on the first locking mechanism 206 and the second locking mechanism 208 thereby keeping them in the inactive and unengaged position. Exemplary biasing elements include compression springs, magnets, elastomers, and similar devices. Expandable reamer blades 212 are attached to the outer surface of housing 204 using reamer cage 214. Reamer cage 214 may be attached to the exterior of housing 204 in any suitable manner, including, but not limited to, bolts, welds, screws, and adhesives. Expandable reamer blades 212 are positioned within an interior space defined by reamer cage 214. The reamer cage 214 allows reamer blades 212 to expand by moving outwards in the radial direction. A second biasing element 216 may be positioned between expandable reamer blades 212 and reamer cage 214 to exert a force on reamer cage 214 and reamer blades 212 thereby keeping them retracted in the inactive and unengaged position. Pressure chamber sleeve 218 is attached to housing 204 to create a pressurized chamber that may be used to actuate BHA 200.

Figure 3:
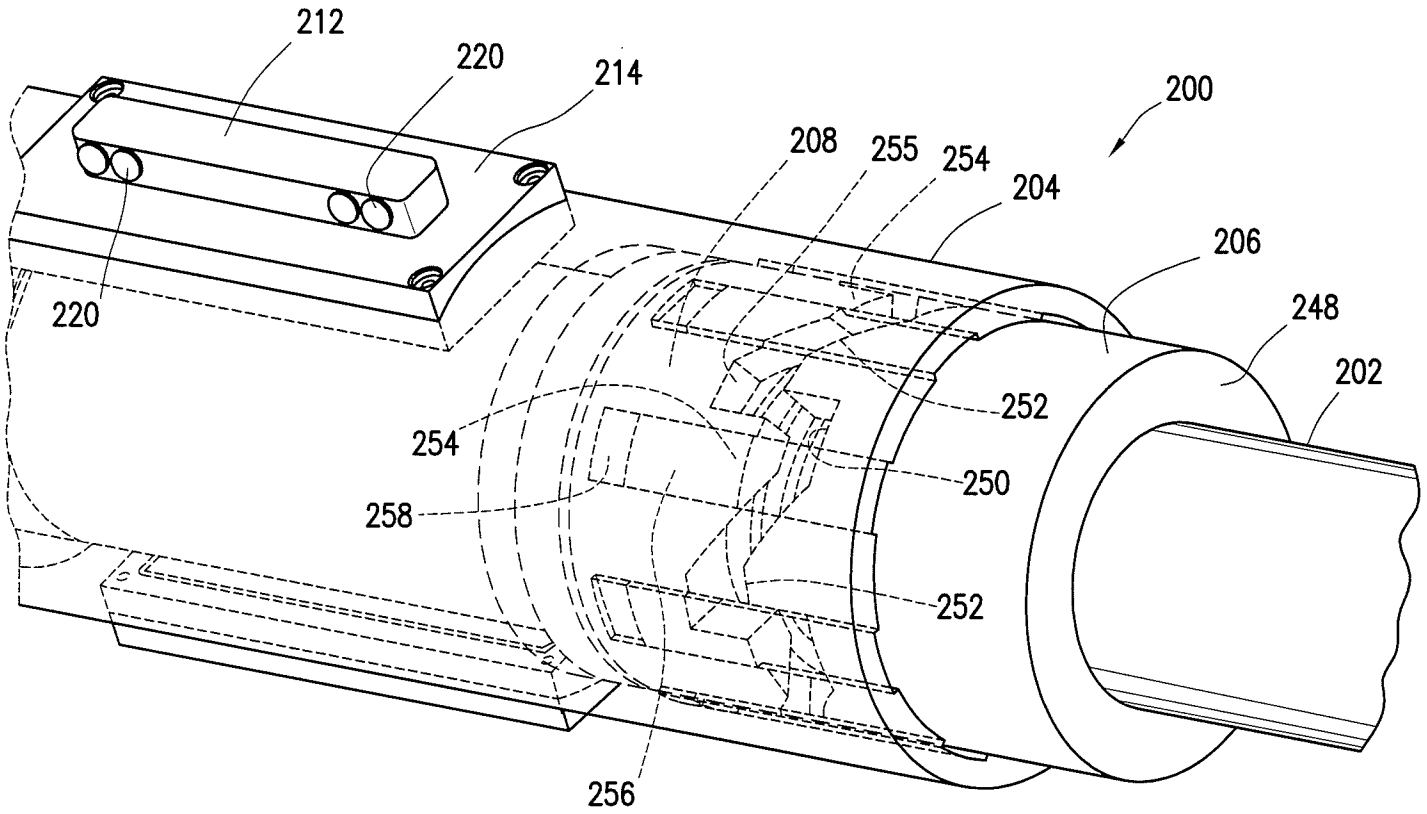
FIG. 3 is a three dimensional view of an embodiment of a bottom-hole assembly shown in the inactive and unengaged position in accordance with certain embodiments of the present disclosure.

FIG. 3 is a three dimensional view of BHA 200 in the inactive and unengaged position in accordance with the present disclosure. Housing 204 is transparent to show the internal positioning of the first locking mechanism 206 and second locking mechanism 208. First locking mechanism 206 and second locking mechanism 208 are shown as generally cylindrical sleeves positioned along the outer circumference 238 of drilling shaft 202. First locking mechanism 206 may comprise a generally flat first face 248 and a second face 250. Second face 250 may comprise a series of teeth 252 protruding along the longitudinal axis of first locking mechanism 206. The teeth 252 may comprise an alternating zigzag pattern that is capable of engaging a reversed alternating pattern of teeth 254 positioned on a face 255 of second locking mechanism 208. Housing 204 may comprise one or more guide grooves 256 extending inward from inner circumference 244. The second locking mechanism 208 may comprise one or more guides 258 positioned along its outer circumference. Guide grooves 256 are spaced and configured to receive the one or more guides 258, thereby rotatably coupling the second locking mechanism 208 and the housing 204. The guides 258 are capable of sliding along guide grooves 256 in the longitudinal direction. In the inactive and unengaged position, the first locking mechanism 206 and second locking mechanism 208 are disengaged and drilling shaft 202 is able to rotate independently of housing 204. Reamer blades 212 extend outward from reamer housing 214 in the radial direction. Reamer blades 212 may comprise cutting surfaces 220 positioned along the surface of reamer blades 212.

A BHA in accordance with the present disclosure may be in operation in its inactive and unengaged position for directional drilling. The drilling shaft 202 is used to rotate a drill bit to create a wellbore in a subterranean formation. During normal drilling operations, the BHA may become stuck in the wellbore due to a portion of the formation caving in around BHA or the curvature of the directionally drilled wellbore being too tight for the BHA to fit without becoming kinked or stuck within the wellbore. The BHA may be switched to the active and engaged position to assist in freeing the BHA from the wellbore by transmitting drive torque to the housing and expanding the expandable reamer blades to enlarge a portion of the wellbore surrounding the BHA. Under certain drilling conditions, it may be desirable to enlarge or widen a portion of the wellbore for purposes other than freeing a stuck BHA.

Figure 4:
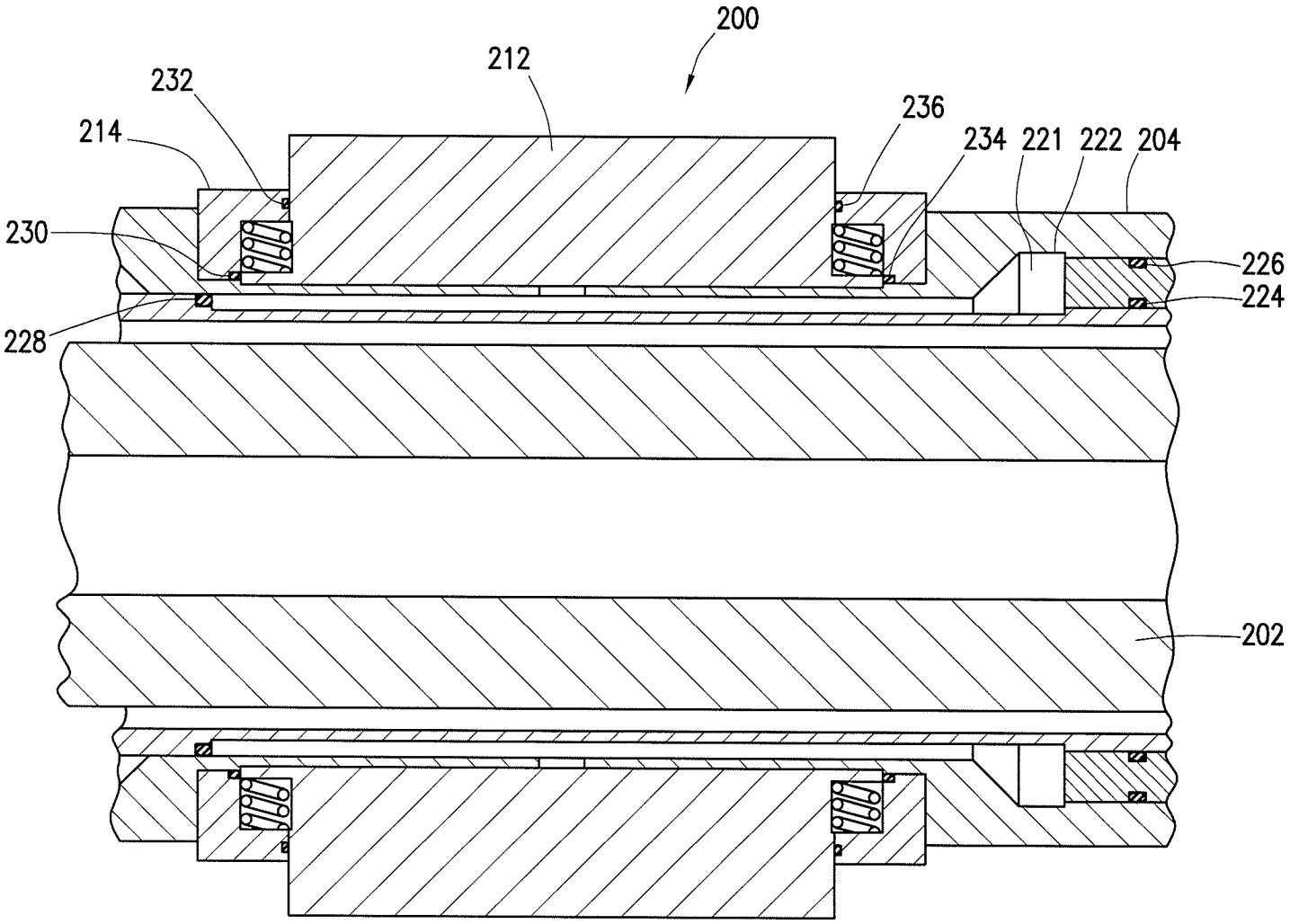
FIG. 4 is a close up cross-sectional view of a portion of an embodiment of a bottom-hole assembly in accordance with certain embodiments of the present disclosure.

Referring now to FIG. 4, a close up cross-sectional view of a portion of BHA 200 is shown. One or more actuators 221 may be used to switch BHA 200 from the inactive and unengaged to the active and engaged position thereby selectively engaging the first locking mechanism 206 with the second locking mechanism 208 and expanding the expandable reamer blades 212. As shown in FIG. 4, the actuator 221 is a hydraulic actuator comprising an incompressible fluid. As would be appreciated by one having ordinary skill in the art with the benefit of the present disclosure, the one or more actuators may be hydraulic actuators, electromagnetic actuators, mechanical actuators, ferrofluid actuators, or any other actuator suitable for the needs of the present disclosure. BHA 200 may be assembled with a sealed chamber 222 that may be filled with actuator 221. Actuator 221 may be positioned within housing 204 such that it is in contact with expandable reamer blades 212 and second locking mechanism 208. Sealed chamber 222 may be fluidically coupled to a hydraulic pump (not shown). A plurality of sealing elements may be used to create sealed chamber 222. A first sealing element 224 creates a fluid seal between the second locking mechanism 208 and the pressure chamber sleeve 218. A second sealing element 226 creates a fluid seal between the second locking mechanism and the housing 204. A third sealing element 228 creates a fluid seal between the housing 204 and the pressure chamber sleeve 218. A fourth sealing element 230 creates a fluid seal between the housing and the reamer cage 214. A fifth sealing element 232 creates a fluid seal between the reamer blades 212 and the reamer cage 214. A sixth sealing element 234 creates a fluid seal between the housing 204 and the reamer cage 214. A seventh sealing element 236 creates a fluid seal between the reamer blades 212 and the reamer cage 214.

To activate BHA 200, hydraulic pump 150 may be activated to pressurize the incompressible fluid based actuator 221 inside sealed chamber 222. The hydraulic pump may be located at a surface location or it may be a mud pump located inside a portion of the wellbore. As the pressure inside sealed chamber 222 increases, the actuator 221 exerts a force against reamer blades 212 and second locking mechanism 208. The pressure inside sealed chamber 222 may increase to a pressure sufficient to overcome the forces exerted by the first biasing mechanism 210 and the second biasing mechanism 216. The expandable reamer blade 212 is then pushed outward in the radial direction to its engaged position. Second locking mechanism 208 is also pushed along the longitudinal axis of drilling shaft 202 to engage with the first locking mechanism 206.

The one or more actuators 221 may be located downhole with BHA 200. BHA 200 may be switched from the inactive and unengaged to the active and engaged position when housing 204 becomes stuck in a portion of the wellbore. Determining that housing 204 has become stuck may be done by operators or control systems at a surface location or it may be done by downhole sensors communicatively coupled to the one or more actuators. The one or more actuators 221 may be selectively operated by an operator or control system from an uphole or surface location. The operator may be able to determine whether or not activation is required in response to data received from one or more downhole sensors. The data may indicate that housing 204 is stuck. The data received may be one or more of, pump pressure, axial force exerted downwards on BHA 200 ("weight on bit"), axial force exerted upwards on BHA 200 ("overpull"), or other similar indications from sensor 140. Alternatively, the one or more actuators 221 may also automatically operate in response to downhole conditions, which indicate a need to free the housing 204 or enlarge a portion of the wellbore. Under certain drilling conditions, BHA 200 is swapped from the inactive and unengaged to the active and engaged position when enlarging a portion of the wellbore above the drill bit is desired. In the active and engaged position, the drilling shaft 202 and the housing 204 are rotatably coupled, allowing the drilling shaft 202 to transmit drive torque to the housing 204. As the drilling shaft 202 rotates, so does the housing 204, assisting in freeing the housing 204 from any obstructions. The reamer blades 212 may expand to contact at least a portion of the wellbore. As the housing 204 rotates, the cutting surfaces 220 of the reamer blades 212 carve out and enlarge the portion of the wellbore. As would be understood by one of ordinary skill in the art having the benefit of the present disclosure, BHA 200 may comprise a single actuator for engaging the first and second locking mechanism and extending the expandable reamer. The single actuator may be activated using an electromagnetic signal, a radio signal, an electric signal, a hydraulic pulse signal, or any other type of suitable signal.

Figure 5:
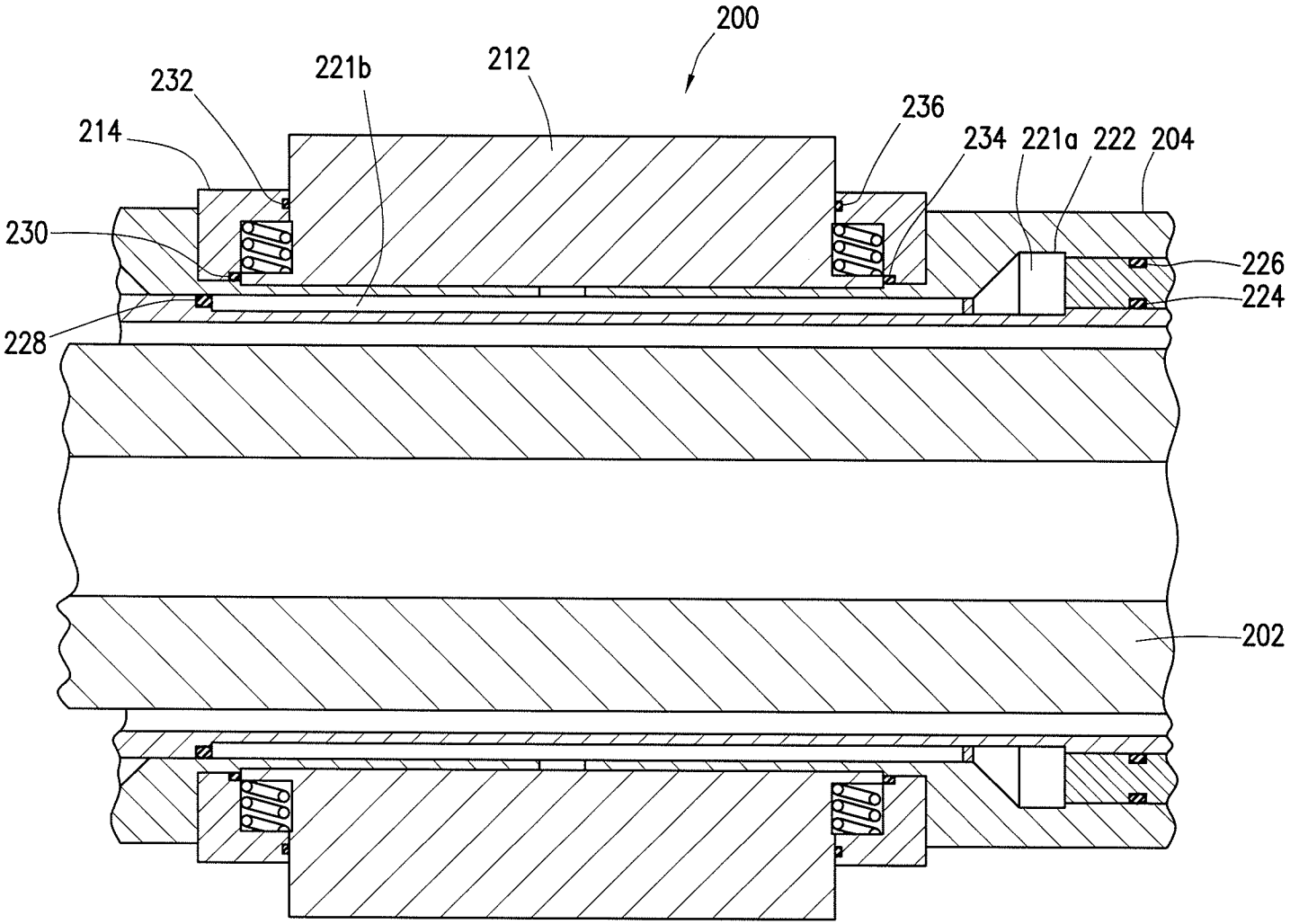
FIG. 5 is a close up cross-sectional view of a portion of an embodiment of a bottom-hole assembly in accordance with certain embodiments of the present disclosure.

Alternatively, BHA 200 may comprise multiple actuators for independently engaging the first and second locking mechanisms and extending the expandable reamer. Referring now to FIG. 5, a close up cross sectional view of BHA 200 is shown with a first actuator 221*a* and a second actuator 221*b*. First actuator 221*a* may be in contact with second locking mechanism 206 and second actuator 221*b* may be in contact with reamer blades 212. First actuator 221*a* and second actuator 221*b* may be activated independently of each other using separate signals. Alternatively, first actuator 221*a* and second actuator 221*b* may be activated at the same time using the same signal. In certain situations where multiple actuators are desirable, the one or more actuators 221 may be the same type of actuators. For example, first actuator 221*a* and second actuator 221*b* are both separate and independent hydraulic actuators. In certain other situations where multiple actuators are desirable, the one or more actuators 221 may be different types of actuators. For example, first actuator 221*a* may be a hydraulic actuator and second actuator 221*b* may be a ferrofluid actuator. The one or more actuators may be activated using an electromagnetic signal, a radio signal, an electric signal, a hydraulic pulse signal, or any other type of suitable signal.

Figure 6:
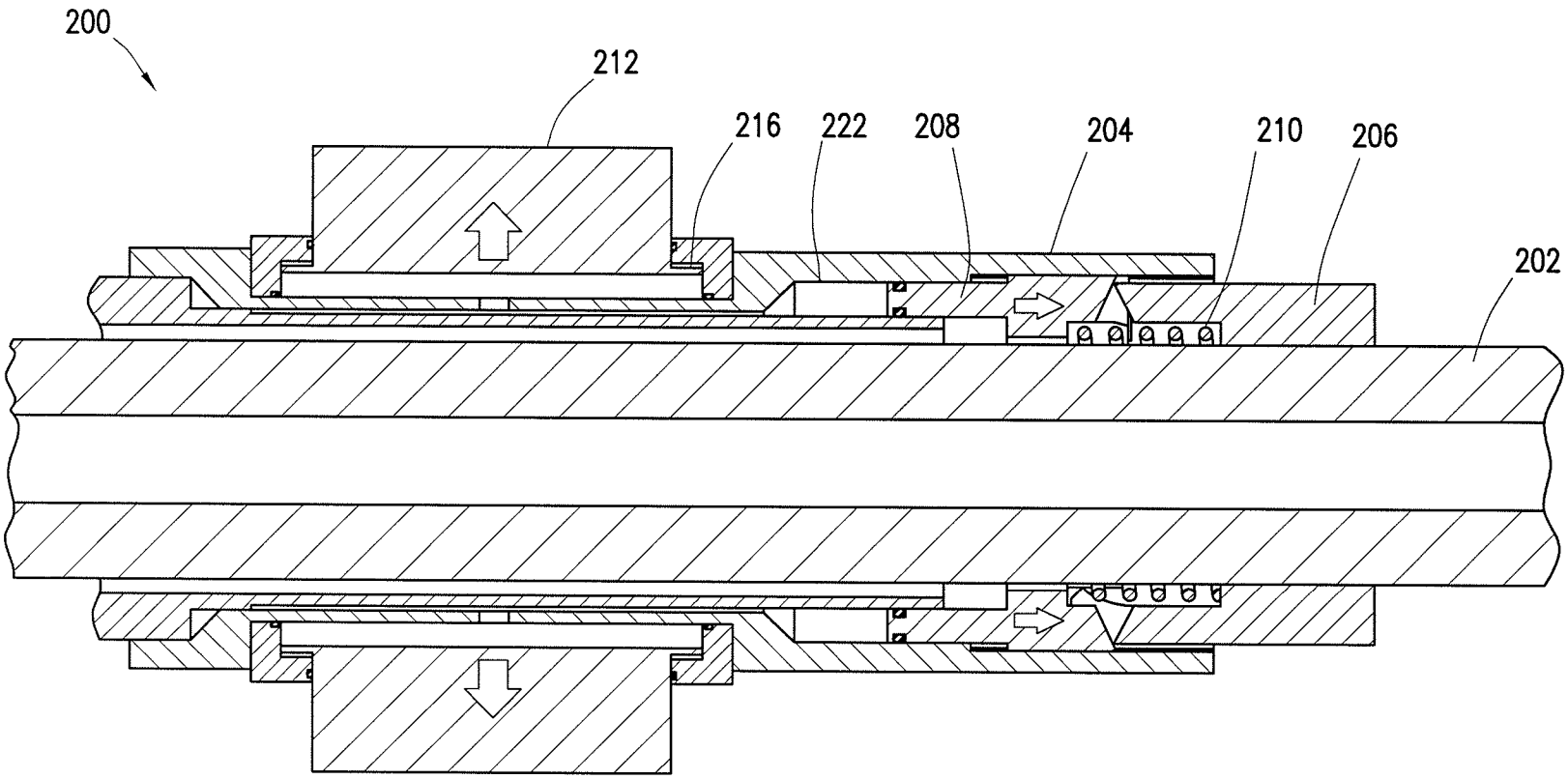
FIG. 6 is a cross-sectional view of an embodiment a bottom-hole shown in an active and engaged position in accordance with certain embodiments of the present disclosure.

FIG. 6 is a cross sectional view of BHA 200 shown in the active and engaged position in accordance with the present disclosure. The pressure inside sealed chamber 222 has reached a pressure sufficient to overcome the force of the first and second biasing mechanisms 210, 216. Reamer blades 212 have moved outward in the radial direction to reach their active and engaged position. The second locking mechanism 208 has moved along a longitudinal axis to engage the first locking mechanism 206, thereby rotatably coupling the drilling shaft 202 and the housing 204. Alternatively, a BHA in accordance with the present disclosure may be configured such that the first locking mechanism 206 is capable of moving along a longitudinal axis to engage the second locking mechanism 208, thereby rotatably coupling the drilling shaft 202 and the housing 204.

Figure 7:
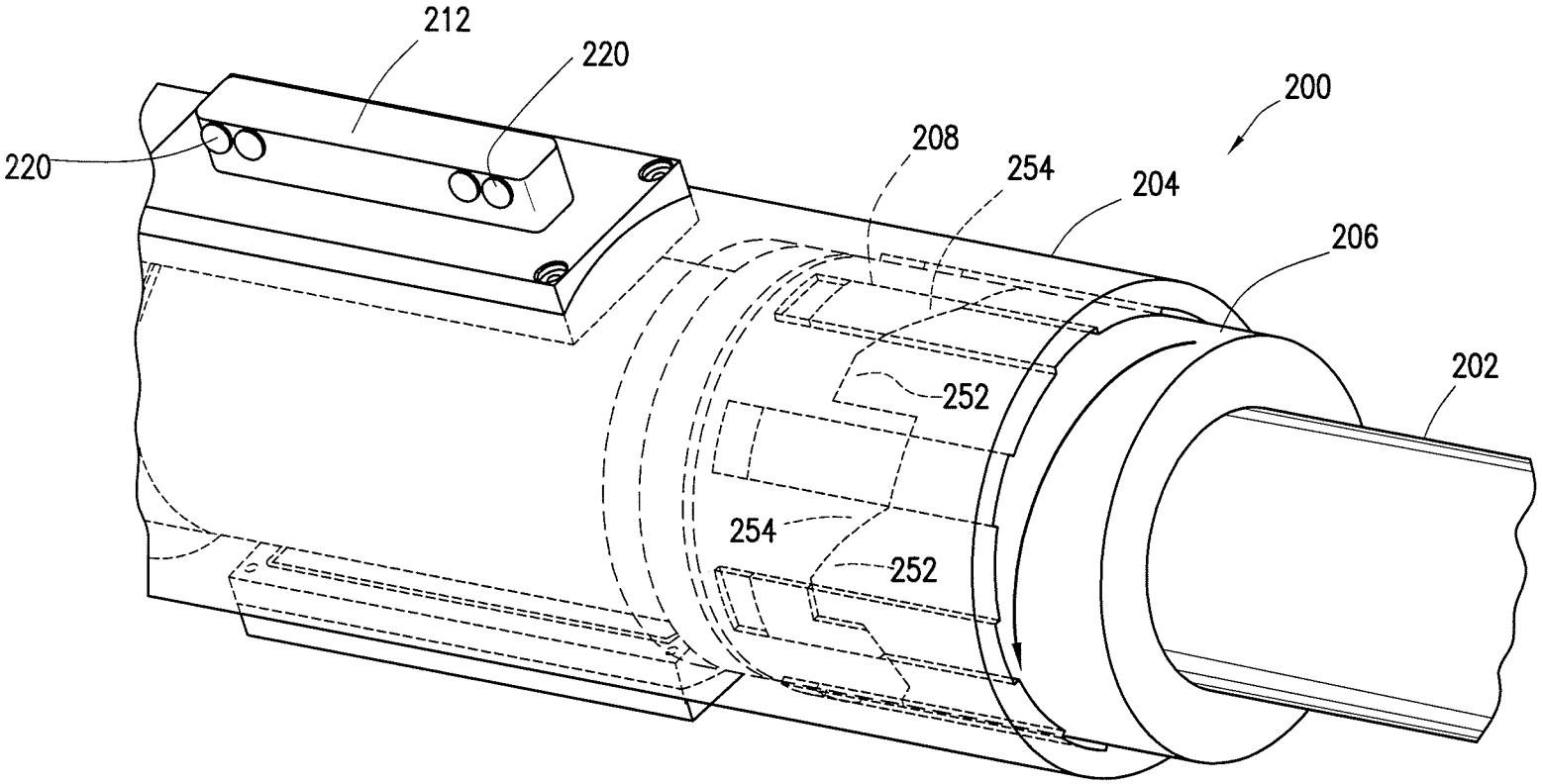
FIG. 7 is a three dimensional view of an embodiment of a bottom-hole assembly shown in the active and engaged position in accordance with certain embodiments of the present disclosure.

FIG. 7 is a three dimensional view of BHA 200 in the active and engaged position in accordance with the present disclosure. The housing 204 is transparent to show the internal positioning of the first locking mechanism 206 and second locking mechanism 208. In the active and engaged position, the first locking mechanism 206 and the second locking mechanism 208 are engaged and the drilling shaft 202 and the housing 204 are rotatably coupled. The second locking mechanism 208 has moved along the longitudinal axis of drilling shaft 202 to engage the first locking mechanism 206. The alternating teeth 252 of the first locking mechanism 206 have come into contact with and engaged with the matching and reverse alternating teeth 254 of the second locking mechanism 208. This allows the drilling shaft 202 to transmit drive torque to the housing 204. Reamer blades 212 extend outward in a radial direction from reamer cage 214. Reamer blades 212 are shown in the extended position wherein the cutting surfaces 220 may contact a portion of the wellbore (not shown), thereby enlarging the wellbore.

As would be appreciated by one having ordinary skill in the art having the benefit of the present disclosure, BHA 200 may be returned to the inactive and unengaged position by reversing the one or more actuators 221. Accordingly, the pressure inside sealed chamber 222 may then decrease to a pressure insufficient to overcome the force exerted by the first biasing mechanism 210 and the second biasing mechanism 216. The first biasing mechanism 210 may then disengage the first locking mechanism 206 and the second locking mechanism 208. The second biasing mechanism 216 may then retract the reamer blade 212 removing it from contact with the wellbore. Thus, BHA 200 may be selectively operated between the active and engaged and inactive and unengaged states throughout the drilling process in response to the needs of a particular drilling operation.

An embodiment of the present disclosure is a bottom-hole assembly comprising a generally tubular housing; a drilling shaft positioned within the housing; a first locking mechanism rotatably coupled to the drilling shaft; a second locking mechanism rotatably coupled to the housing and positioned adjacent to the first locking mechanism; and an expandable reamer attached to the housing.

Another embodiment of the present disclosure is a method of underreaming a wellbore comprising rotating a drilling shaft coupled to a drill bit about its axis to form a wellbore; engaging a first locking mechanism rotatably coupled to the drilling shaft with a second locking mechanism coupled to a housing having an expandable reamer attached thereto to rotatably couple the drilling shaft and the housing; expanding the expandable reamer attached to the housing into engagement with the wellbore; and rotating the expandable reamer to widen at least a portion of the wellbore uphole from the drill bit.

Another embodiment of the present disclosure is a method of freeing a bottom-hole assembly comprising determining that a housing coupled to a drilling shaft is trapped in a portion of a wellbore; engaging a first locking mechanism coupled to the drilling shaft and a second locking mechanism coupled to the housing to rotationally couple the drilling shaft to the housing; expanding an expandable reamer attached to the housing to contact a portion of the wellbore; and rotating the drilling shaft to rotate the housing.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A bottom-hole assembly comprising:

a generally tubular housing;

a drilling shaft positioned within the housing;

a first locking mechanism rotatably coupled to the drilling shaft;

a second locking mechanism rotatably coupled to the housing and positioned adjacent to the first locking mechanism;

an expandable reamer attached to the housing; and one or more actuators positioned within the generally tubular housing, which exert one or more forces sufficient to push the first locking mechanism into engagement with the second locking mechanism and push the expandable reamer outward in the radial direction at the same time, wherein the drilling shaft is rotatable relative to the generally tubular housing when the first locking mechanism and second locking mechanism are unengaged and the drilling shaft is rotatably coupled to the generally tubular housing when the first locking mechanism and second locking mechanism are engaged.

2. The bottom-hole assembly of claim 1, wherein:

the housing comprises an interior circumference;

the drilling shaft comprises an outer circumference; and the inner circumference of the housing is sufficiently larger than the outer circumference of the drilling shaft to allow for rotational motion of the drilling shaft independent from the housing in the unengaged position.

3. The bottom-hole assembly of claim 1, wherein at least one of the one or more actuators comprises a hydraulic actuator.

4. The bottom-hole assembly of claim 1, wherein the one or more actuators further comprises a first actuator positioned within the generally tubular housing, which exerts a force sufficient to push the first locking mechanism into engagement with the second locking mechanism.

5. The bottom-hole assembly of claim 4, wherein the one or more actuators further comprises a second actuator positioned between the expandable reamer and the housing, which expands the expandable reamer by exerting a force sufficient to push the expandable reamer outward in the radial direction.

6. The bottom-hole assembly of claim 1, wherein:

the first locking mechanism further comprises a series of alternating teeth extending from a cylindrical face of the first locking mechanism; and the second locking mechanism further comprises a corresponding and complementary series of alternating teeth extending from a cylindrical face of the second locking mechanism.

7. The bottom-hole assembly of claim 6, wherein the series of alternating teeth and the corresponding and complementary series of alternating teeth are configured to transmit a drive torque to the housing in the engaged position.

8. The bottom-hole assembly of claim 1, further comprising:

one or more guide grooves radially recessed within an interior circumference of the housing; and one or more guides corresponding to the one or more guide grooves and positioned along an outer circumference of the second locking mechanism; and wherein the second locking mechanism is capable of moving along a longitudinal axis of the drilling shaft using the one or more guide grooves and corresponding one or more guides.

9. The bottom-hole assembly of claim 1, further comprising a first biasing mechanism positioned between the first locking mechanism and the second locking mechanism.

10. The bottom-hole assembly of claim 9, further comprising:

a reamer cage attached to the exterior of the housing; and a second biasing mechanism positioned between the expandable reamer and the reamer cage capable of exerting a force to bias the expandable reamer radially inward in the unengaged position.

11. A method of underreaming a wellbore comprising:

rotating a drilling shaft coupled to a drill bit about its axis and relative to a housing to form a wellbore;

engaging a first locking mechanism rotatably coupled to the drilling shaft with a second locking mechanism coupled to the housing having an expandable reamer attached thereto to rotatably couple the drilling shaft and the housing;

expanding the expandable reamer attached to the housing into engagement with the wellbore;

rotating the expandable reamer to widen at least a portion of the wellbore uphole from the drill bit; and activating one or more actuators positioned within the housing to selectively engage the first locking mechanism with the second locking mechanism by exerting a force sufficient to slide the second locking mechanism along a longitudinal axis of the drilling shaft and expand the expandable reamer by exerting a force sufficient to move the expandable reamer outward in the radial direction at the same time.

12. The method of claim 11, wherein activating the one or more actuators further comprises sending one or more signals to the one or more actuators, wherein the one or more signals are selected from the group consisting of an electric signal, a radio signal, an electromagnetic signal, a hydraulic pulse signal, or any combination thereof.

13. The method of claim 11, wherein activating the one or more actuators further comprises activating an actuator to push the second locking mechanism into engagement with the first locking mechanism by overcoming a force exerted by a biasing mechanism positioned between the first locking mechanism and the second locking mechanism.

14. The method of claim 11, wherein activating the one or more actuators further comprises activating an actuator to push the expandable reamer outward in the radial direction by overcoming a force exerted by a biasing mechanism positioned between the expandable reamer and a reamer cage attached to the exterior of the housing.

15. The method of claim 11, further comprising receiving data from a downhole sensor that indicates that the housing is stuck in the wellbore.

16. A method of freeing a bottom-hole assembly comprising:

determining that a housing coupled to a drilling shaft is trapped in a portion of a wellbore;

engaging a first locking mechanism coupled to the drilling shaft and a second locking mechanism coupled to the housing to rotationally couple the drilling shaft to the housing;

expanding an expandable reamer attached to the housing to contact a portion of the wellbore;

rotating the drilling shaft to rotate the housing; and activating one or more actuators positioned within the housing to selectively engage the first locking mechanism with the second locking mechanism by exerting a force sufficient to slide the second locking mechanism along a longitudinal axis of the drilling shaft and expand the expandable reamer by exerting a force sufficient to move the expandable reamer outward in the radial direction at the same time, wherein the drilling shaft is rotatable relative to the housing when the first locking mechanism and second locking mechanism are unengaged and the drilling shaft is rotatably coupled to the housing when the first locking mechanism and second locking mechanism are engaged.

17. The method of claim 16, further comprising:

contacting the portion of the wellbore with one or more cutting surfaces of the expandable reamer; and widening at least a portion of the wellbore uphole from a drill bit.

* * * * *